US009267218B2

(12) United States Patent
Luo et al.

(10) Patent No.: US 9,267,218 B2
(45) Date of Patent: Feb. 23, 2016

(54) PROTECTIVE COATING FOR TITANIUM LAST STAGE BUCKETS

(75) Inventors: Yuefeng Luo, Mechanicville, NY (US); William Edward Adis, Scotia, NY (US)

(73) Assignee: General Electric Company, Schenectady, NY (US)

( * ) Notice: Subject to any disclaimer, the term of this patent is extended or adjusted under 35 U.S.C. 154(b) by 813 days.

(21) Appl. No.: 13/224,628

(22) Filed: Sep. 2, 2011

(65) Prior Publication Data

US 2013/0058791 A1 Mar. 7, 2013

(51) Int. Cl.

| | |
|---|---|
| ***F01D 5/28*** | (2006.01) |
| ***C25D 7/00*** | (2006.01) |
| ***C25D 11/18*** | (2006.01) |
| ***C25D 11/24*** | (2006.01) |
| ***C25D 11/26*** | (2006.01) |
| ***C22C 14/00*** | (2006.01) |
| *C25D 17/00* | (2006.01) |
| *C25D 11/02* | (2006.01) |
| *C25D 11/20* | (2006.01) |

(52) U.S. Cl.

CPC ..... *C25D 7/008* (2013.01); *C22C 14/00* (2013.01); *C25D 11/18* (2013.01); *C25D 11/246* (2013.01); *C25D 11/26* (2013.01); *F01D 5/288* (2013.01); *C25D 11/024* (2013.01); *C25D 11/20* (2013.01); *C25D 17/008* (2013.01); *F05D 2220/31* (2013.01); *F05D 2220/3215* (2013.01); *F05D 2230/90* (2013.01); *F05D 2240/303* (2013.01); *F05D 2300/132* (2013.01); *F05D 2300/174* (2013.01); *F05D 2300/21* (2013.01); *F05D 2300/43* (2013.01); *F05D 2300/432* (2013.01); *F05D 2300/434* (2013.01); *F05D 2300/514* (2013.01)

(58) Field of Classification Search

CPC ..... F01D 5/28
USPC ..... 416/241 R; 427/205
See application file for complete search history.

(56) References Cited

U.S. PATENT DOCUMENTS

| | | | | |
|---|---|---|---|---|
| 3,647,647 | A * | 3/1972 | Winfree | 205/212 |
| 3,691,029 | A * | 9/1972 | Raymond et al. | 205/115 |
| 3,725,217 | A * | 4/1973 | Hartshorn | 428/472.1 |
| 3,890,456 | A * | 6/1975 | Dils | 428/216 |
| 4,029,477 | A * | 6/1977 | Grisik | 428/680 |
| 4,354,905 | A * | 10/1982 | Yoshida et al. | 205/531 |
| 4,416,739 | A * | 11/1983 | Turner | 205/181 |

(Continued)

OTHER PUBLICATIONS

Dunleavy et al., < . Characterisation of discharge events during plasma electrolytic oxidation. Surface & Coatings Technology 203 (2009) 3410-3419 [ > serial < online], [retrieved on Feb. 6, 2014]. Retrieved from the Internet <URL: > http://eprints.soton.ac.uk/267632/1/cd_iog_sct_203(2009)_p3410.pdf< >.*

(Continued)

*Primary Examiner* — Craig Kim
*Assistant Examiner* — Wayne A Lambert
(74) *Attorney, Agent, or Firm* — Ernest G. Cusick; Hoffman Warnick LLC

(57) ABSTRACT

Described herein a bucket for use in the last stage of a steam turbine engine. The bucket includes a titanium-based alloy having a leading edge wherein the leading edge includes titania having a plurality of pores and a top sealing layer filling the plurality of pores, the sealing layer selected from the group consisting of: chromium, cobalt, nickel, polyimide, polytetrafluoroethylene and polyester.

18 Claims, 3 Drawing Sheets

(56) References Cited

U.S. PATENT DOCUMENTS

| | | | | | |
|---|---|---|---|---|---|
| 4,530,739 | A * | 7/1985 | Hanak et al. | 427/74 |
| 4,548,682 | A * | 10/1985 | Yoshida et al. | 205/119 |
| 4,787,962 | A * | 11/1988 | Temprano et al. | 205/181 |
| 4,839,237 | A * | 6/1989 | Coulon et al. | 428/610 |
| 4,902,388 | A * | 2/1990 | Fornwalt et al. | 205/212 |
| 5,077,140 | A * | 12/1991 | Luthra et al. | 428/660 |
| 5,122,182 | A * | 6/1992 | Dorfman et al. | 75/252 |
| 5,385,662 | A * | 1/1995 | Kurze et al. | 205/316 |
| 5,393,200 | A | 2/1995 | Dinh et al. | |
| 5,487,825 | A * | 1/1996 | Kurze et al. | 205/200 |
| 5,683,226 | A * | 11/1997 | Clark et al. | 415/200 |
| 5,900,278 | A * | 5/1999 | Coffinberry et al. | 427/227 |
| 6,197,178 | B1 | 3/2001 | Patel et al. | |
| 6,365,028 | B1 | 4/2002 | Shatrov | |
| 6,447,924 | B1 * | 9/2002 | Bettridge | 428/469 |
| 6,896,785 | B2 | 5/2005 | Shatrov et al. | |
| 7,195,455 | B2 | 3/2007 | Stonitsch et al. | |
| 7,744,343 | B2 | 6/2010 | Burdgick et al. | |
| 7,758,968 | B2 * | 7/2010 | Schmitz et al. | 428/469 |
| 2003/0150419 | A1 | 8/2003 | Daragheh et al. | |
| 2003/0155231 | A1 * | 8/2003 | Weng | 204/227 |
| 2007/0102300 | A1 * | 5/2007 | Dai | 205/205 |
| 2009/0127246 | A1 | 5/2009 | Hendricks et al. | |
| 2009/0223829 | A1 | 9/2009 | Gao et al. | |
| 2009/0250351 | A1 * | 10/2009 | Ostrovsky | 205/107 |

OTHER PUBLICATIONS

Yerokhin et al., < .Plasma electrolysis for surface engineering. Surface and Coatings Technology 122 (1999) 73-93 [ > serial < online], [retrieved on Feb. 6, 2014]. Retrieved from the Internet <URL: > http://www.sciencedirect.com/science/article/pii/S0257897299004417< >.*

Walsh et al.,. Plasma electrolytic oxidation (PEO) for . . . Transactions of the Institute of Metal Finishing 2009 vol. 87 No. 3. Retrieved from Internet electronic mail: <http://eprints.soton.ac.uk/>, Retrieved from the Internet: <Frank Walsh <electro@chemeng.fsnet.co.uk>.*

* cited by examiner

PROTECTIVE COATING FOR TITANIUM LAST STAGE BUCKETS

BACKGROUND OF THE INVENTION

The present invention relates to large titanium buckets for use in the last stage of steam turbine engines and to the method for manufacturing such high strength buckets. Specifically, the invention relates to titanium buckets having better erosion resistance.

It is generally recognized that the performance of a steam turbine engine is greatly influenced by the design and performance of later stage buckets operating at reduced steam pressures. Ideally, the last stage bucket should efficiently use the expansion of steam down to the turbine exhaust pressure, while minimizing the kinetic energy of the steam flow leaving the last stage.

The service requirements of steam turbine buckets can be complex and demanding. Last stage buckets, in particular, are routinely exposed to a variety of severe operating conditions, including the corrosive environments caused by high moisture and the carry-over from the boiler. Such conditions can lead to serious corrosion and pitting problems with the bucket material, particularly in longer, last stage turbine buckets. Thus, for some time, last stage buckets for turbines have been the subject of repeated investigations and development work in an effort to improve their efficiency under harsh operating conditions, since even small increases in bucket efficiency and life span can result in significant economic benefits over the life of a steam turbine engine.

Last stage turbine buckets are exposed to a wide range of flows, loads and strong dynamic forces. Thus, from the standpoint of mechanical strength and durability, the primary factors that affect the final bucket profile design include the active length of the bucket, the pitch diameter and the operating speed in the operative flow regions. Damping, bucket fatigue and corrosion resistance of the materials of construction at the maximum anticipated operating conditions also play an important role in the final bucket design and method of manufacture.

The development of larger last stage turbine buckets poses additional design problems due to the inertial loads that often exceed the strength capability of conventional bucket materials. Steam turbine buckets, particularly last stage buckets with longer vanes, experience higher tensile loadings and thus are subject to cyclic stresses which, when combined with a corrosive environment, can be very damaging to the bucket over long periods of use. In addition, the steam in the last stages normally is "wet," i.e., containing a higher amount of saturated steam. As a result, water droplet impact erosion of the bucket material often occurs in the last stage. Such erosion reduces the useable service life of the bucket and the efficiency of the steam turbine as a whole.

In the past, it has been difficult to find bucket materials capable of meeting all of the mechanical requirements for different end use applications, particularly mechanical designs in which longer vane buckets have been employed. Invariably, the longer buckets have increased strength requirements and, as noted above, suffer from even greater erosion and pitting potential. The higher stresses inherent in longer vane designs also increase the potential for stress corrosion cracking at elevated operating temperatures because the higher strength required in the bucket material tends to increase the susceptibility to stress cracking at operating temperatures at or near 140° F. The effects of pitting corrosion and corrosion fatigue also increase with the higher applied stresses in last stage buckets having longer vane lengths.

The strength of titanium buckets is lower than that of stainless steel buckets, and therefore titanium buckets can tolerate less erosion loss before a catastrophic failure. Near-zero erosion loss for titanium buckets is desirable. Moreover, titanium buckets are also more expensive than stainless steel buckets; thus for a titanium bucket to be cost effective, longer service life and less erosion loss of titanium buckets is desirable.

BRIEF SUMMARY OF THE INVENTION

Embodiments of the invention include a bucket for use in the last stage of a steam turbine engine, the bucket having a titanium-based alloy having between about 3% and 6.25% by weight aluminum, up to 3.5% vanadium, up to 2.25% tin, up to 2.25% zirconium, between about 1.75% and 5.0% molybdenum, up to 2.25% chromium, up to 0.7% silicon and up to 2.3% iron, with the balance being titanium. The bucket includes a leading edge wherein the leading edge includes titania having a plurality of pores and a top sealing layer filling the plurality of pores the sealing layer selected from the group consisting of: chromium, cobalt, nickel, polyimide, polytetrafluoroethylene and polyester.

Embodiments of the present invention also include a method for manufacturing a last stage turbine bucket for use in a steam turbine engine. The method includes forming a steam turbine bucket having a titanium-based alloy having between about 3% and 6.25% by weight aluminum, up to 3.5% vanadium, up to 2.25% tin, up to 2.25% zirconium, between about 1.75% and 5.0% molybdenum, up to 2.25% chromium, up to 0.7% silicon and up to 2.3% iron, with the balance being titanium. The method includes applying a high voltage to a leading edge of said bucket in an electrolyte to form a titania transition layer and a top porous layer. The top porous layer is sealed with a material selected from the group consisting of: chromium, cobalt nickel, polyimide, polytetrafluoroethylene and polyester.

Embodiments of the present invention also include an article. The article includes a titanium-based alloy having a leading edge, wherein the leading edge includes titania having a plurality of pores, and a top sealing layer filling the plurality of pores the sealing layer selected from the group consisting of: chromium, cobalt, nickel, polyimide, polytetrafluoroethylene and polyester.

The above described and other features are exemplified by the following detailed description.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

DETAILED DESCRIPTION

Figure 1:
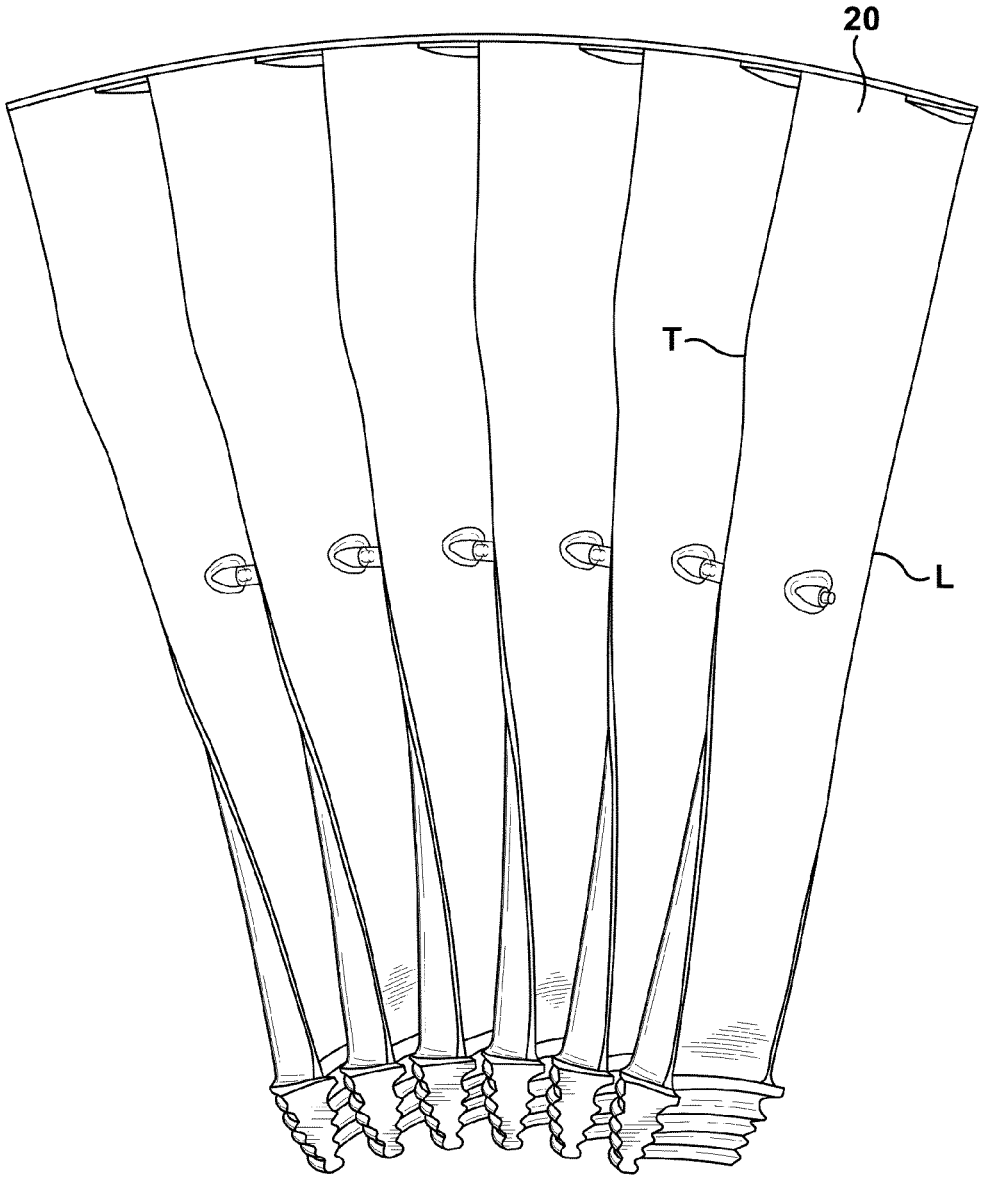
FIG. 1 is a front elevation view of exemplary steam turbine buckets in accordance with aspects of the invention.

FIG. 1 of the drawings is a front elevation view of a portion of a steam turbine wheel depicting a plurality of exemplary last stage steam turbine buckets (shown generally as 20). L in FIG. 1 is the leading edge and is subject to the harshest conditions. It is essential that the leading edge L of the steam turbine buckets 20 be resistant to erosion. Higher erosion resistance of titanium last stage buckets (LSB) allows for better turbine performance and economics. In some circumstances, it is beneficial that the trailing edge T of last stage buckets 20 have improved erosion resistance. The trailing edge T is the edge opposite the leading edge L.

There is not an effective coating for titanium buckets in the prior art because dissimilar materials are difficult to coat on titanium. Titanium is not compatible with most harder metallic materials because of brittle and weak intermetallics. Using plasma vapor deposition (PVD) or chemical vapor deposition (CVD) for coating on titanium does not build a layer thick enough for erosion resistance. Other cladding and welding at high temperature tends to degrade the base titanium materials.

Titanium alloys have been used to manufacture last stage buckets; however, higher erosion resistance of titanium alloys will allow even longer bucket design with higher maximum tip speed. Larger annulus for the longer buckets lead to higher efficiency and fewer stages in the turbine. Fewer stages reduce hardware cost for steam turbines.

The leading edge of the last stage bucket is most susceptible to erosion.

Suitable titanium alloys used for last stage bucket include titanium, titanium based alloy and titania as a coating material. Titanium-based alloys according to the invention have the exemplary weight percentages shown below in Table I:

TABLE I

| Al | V | Sn | Zr | Mo | Cr | Si | Fe | Ti |
|---|---|---|---|---|---|---|---|---|
| 3% to 6.25% | Up to 3.5% | Up to 2.25% | Up to 2.25% | 1.75% to 5.0% | Up to 2.25% | Up to 0.7% | Up to 2.3% | Balance |

This titanium alloy is described in U.S. Pat. No. 7,195,455 and incorporated in its entirety by reference herein. Other titanium-based alloys used to form buckets according to the invention display either a beta or alpha beta structure and achieve a minimum fracture toughness of about 50 ksi root square inches.

Exemplary profiles for longer vane last stage buckets capable of being formed with titanium alloys according to the invention are described in commonly-owned U.S. Pat. No. 5,393,200, entitled "Bucket for the Last Stage of Turbine" and incorporated in its entirety by reference herein. The titanium, and titanium alloys are then treated to improve the erosion resistance of the leading edge.

Figure 2:
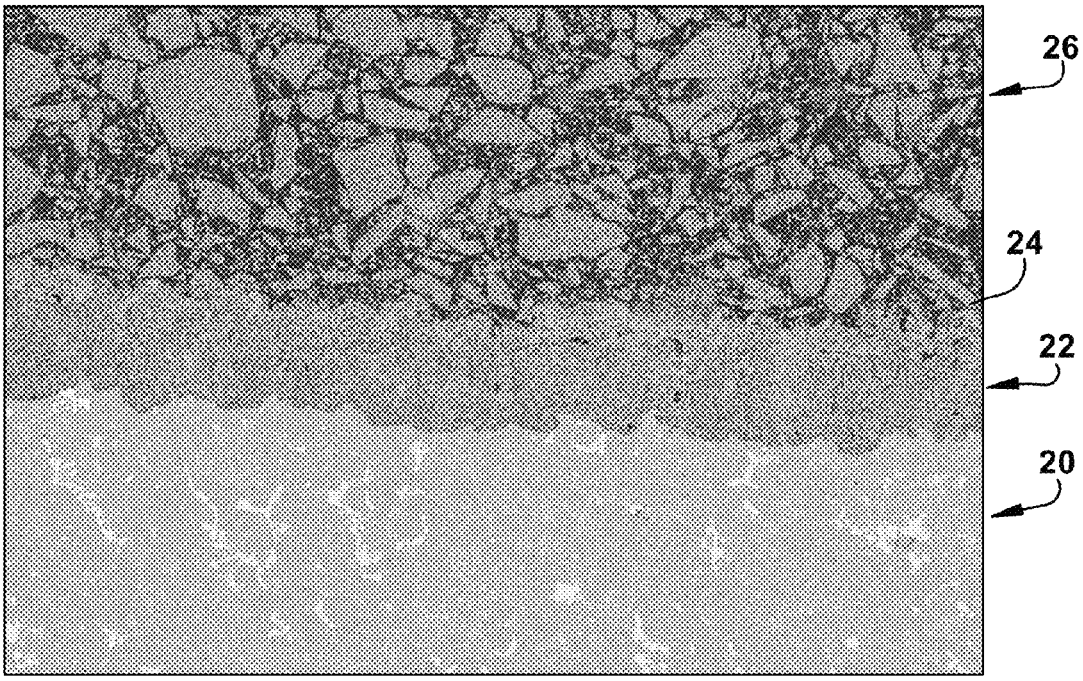
FIG. 2 is a sectional view of a titanium alloy treated to have a protective surface coating in accordance with aspects of the invention.
Figure 3:
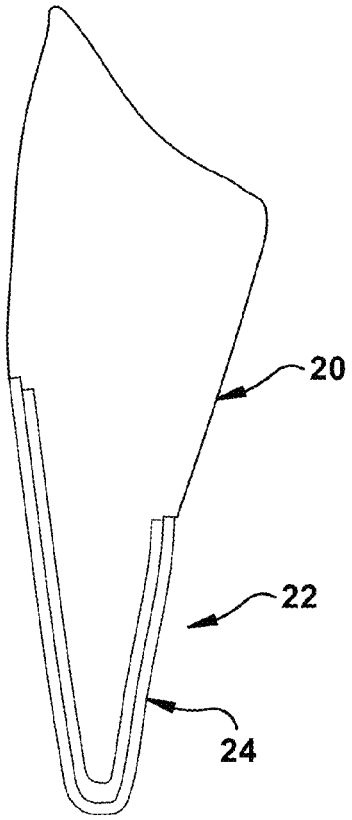
FIG. 3 is a cross-sectional view of a leading edge of a last stage bucket treating according to embodiments described herein in accordance with aspects of the invention.

FIG. 2 shows a sectional view of the coating structure of a treated leading edge or trailing edge of a last stage bucket. The base metal 20 has a titania layer 22 that has been sealed with top sealing layer 24. Layer 26 in FIG. 2 is a mounting material for the microscopic section view and is not part of the coating. FIG. 3 shows a cross-sectional view of the leading edge of a last stage bucket (a trailing edge may be similar). The leading edge has a titania layer 22 and a top sealing layer 24 on the base metal 20.

In the initial step to improve the leading edge, the base metal 20 is subjected to a contact plasma process in an electrolyte to convert the outer surface material to titania. The thickness of the titania layer 22 reaches up to 200 micrometers. The hardness of the titania layer increase to about 1000 HV, an increased of 360 HV from the base material. The titania layer 22 contains pores for electrical discharge. The pores allow plasma channels at high temperature to convert titanium into titanium oxide or titania. A plasma channel starts from the liquid interface and proceeds through the titania layer. Then a top sealing layer 24 fills the pores to increase the surface toughness. The top sealing layer 24 is selected from the group consisting of metallic materials, cobalt, chromium, nickel, vanadium, or alloys of these materials. Other top seal coating material are selected from the group consisting of hard polymeric materials, such as polyimide, polytetrafluoroethylene (PTFE), or polyester. It is possible to provided doped metallic or ceramic particles into the polymeric materials prior to applying the top sealing layer 24.

Figure 4:
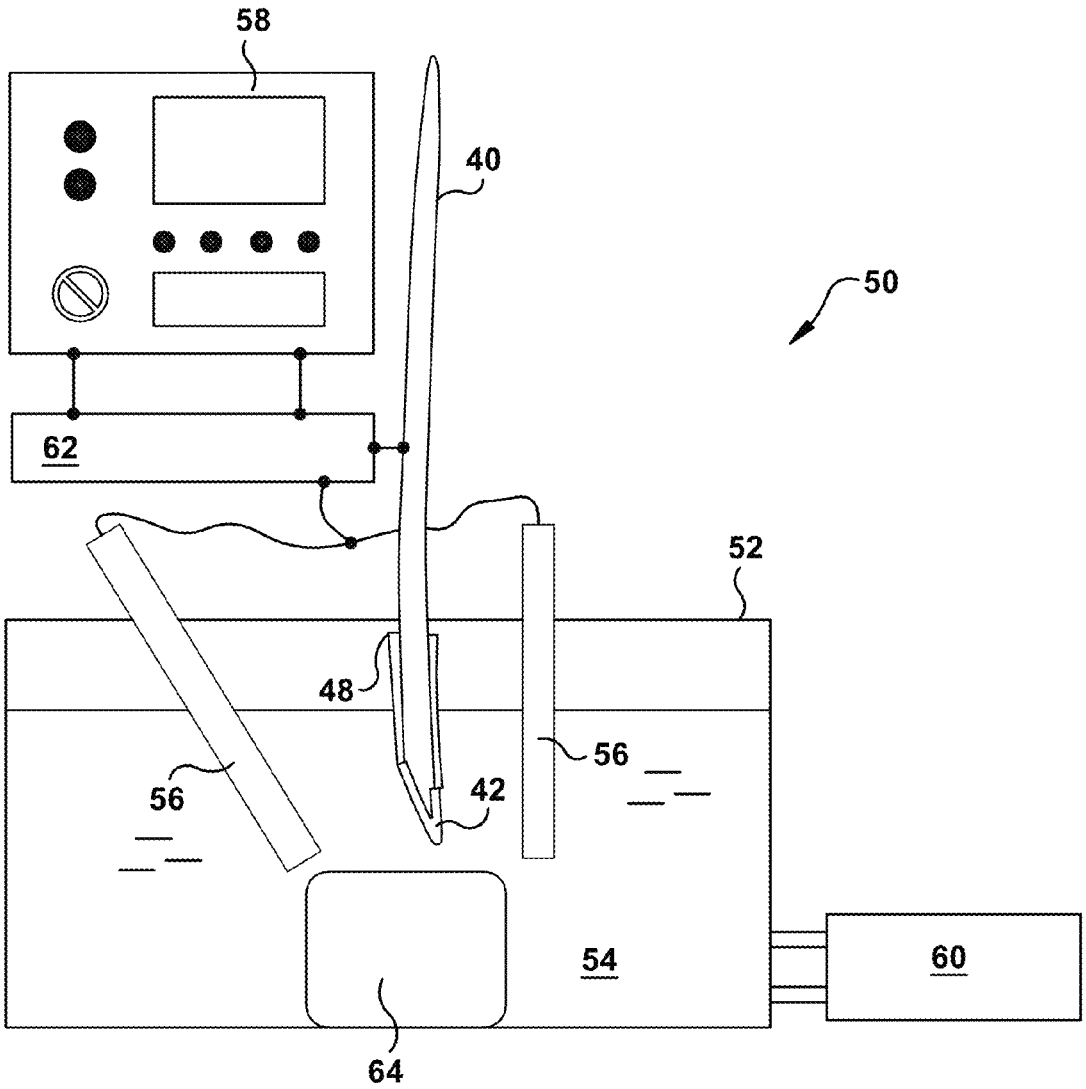
FIG. 4 is a apparatus used to treat leading edges of last stage buckets according to embodiments described herein in accordance with aspects of the invention.

FIG. 4 shows an apparatus 50 for applying the coating to a leading edge 42 of a bucket 40 (also referred to as vanes). The apparatus for performing the contact plasma process includes a container 52 containing an electrolytic solution 54. The bucket 40 is the anode and cathodes 56 are inserted in the electrolytic solution 54 on each side of the leading edge 42 of the bucket 40. A high frequency biased AC voltage source 58 provides high voltage between the bucket 40 and the cathode 56 to generate high temperature moving sparks on the leading edge 42. Since the power is in a form of biased alternate current or voltage, the electrode polarities, anode and cathode, are relatively defined. In an embodiment, the applied voltage ranges from about 300V peak voltage to about 1200V, or in embodiments from about 400V peak voltage to about 1000V, or in embodiments from about 500V peak voltage to about 800V. Process power can be DC, AC or pulsed wave. High frequency biased AC or DC pulse sources are effective; thus polarity can change but bias to one side significantly. The electrolytic solution 54 contains potassium hydroxide with a concentration of from about 0.02 grams/liter to about 0.2 grams/liter leading to a pH greater than about 9. The electrolytic solution contains sodium silicate at a concentration of from about 0.1 grams/liter to about 2.8 grams/liter providing a conductivity of about 0.3 millisiemens/cm to about 12 millisiemens/cm, or in embodiments from about 0.5 millisiemens/cm to about 10 millisiemens/cm, or in embodiments of about 1.0 millisiemens/cm to about 5 millisiemens/cm. A filtration and circulating system 60 is provided to maintain the temperature and cleanness of the electrolyte. The power source can be AC, DC, or pulsed DC with high frequency from about 20 Hz to about 12000 Hz, or in embodiments from about 20 Hz to about 1200 Hz, or in embodiments from about 100 Hz to about 1000 Hz.

A biasing circuit 62 enables the application of any bipolar AC source. The leading edge 42 is submerged into the electrolytic solution 54 with power connected to the anode or the bucket 40. The leading edge 42 of the bucket 40 is left uncovered in the electrolytic solution 54 through the use of masks 48. The masks 48 can be polymer tapes. It is also possible to submerge part of the leading edge where coating is necessary by sealing off the rest of part surface. The cathodes 56 are large stainless or copper plates surrounding leading edge 42 of the bucket 40 area to be coated. Plate surfaces of the cathodes 56 follow the side surfaces of leading edge 42 as shown in FIG. 4. An electrical field distributor 64 is positioned in container 52. Electric field distributor 64 is an insulator that displaces electrolyte near the leading edge 42 of the bucket 40. The electric field distributor 64 alters the electrical field to reduce the field concentration at the leading edge 42 of the bucket 40. The electrical field distributor shape or profile is optimized for the electrical field distribution. The objective is to achieve more uniform electrical field around the leading edge 42. The peak electrical field occurs at the tip of the leading edge. The peak electrical field can be minimized by changing the profile of the insulator to concave or convex depending on the leading edge shape. It is possible to optimize the electrical field for each type of bucket or blade. When power is applied sparks are generated between the anode (leading edge 42) and cathodes 56.

The moving sparks cover all the exposed or unmasked surfaces at the leading edge 42 of the bucket 40. The electrolytic reaction produces a lot of oxygen at the anode (leading 42) while the high temperature plasma immediately oxidizes the substrate titanium into titanium oxide. The cooling rate is extremely high and the hardness of resultant titania is around 1000 HV. The coating thickness of the titania can reach from about 20 micrometers to about 180 micrometers, or in embodiments from about 30 micrometers to about 160 micrometers, or in embodiments from about 40 micrometers to about 150 micrometers.

The top most part of the leading edge 42 after treatment described above may be loose with a denser bottom layer. High frequency, e.g., greater than 200 Hz, may be applied to increase the coating density. As shown in FIG. 2, the layer structure from the contact plasma oxidation consists of three layers on the titanium substrate. The top layer can be loose and porous. The transition layer is very thin and strong since there is no adhesion but conversion.

The sharp geometry of the leading edge causes concentration of electrical field near the edge. Field concentration leads to overly crowed sparks and overheating. Irregular coating and local defects create a problem with the coating quality. In FIG. 4, electrode 56 is in two pieces with an electrode opening just in front of the leading edge to reduce the concentration of electrical field around the sharp geometry. Electrical field distributor 64 is an insulating block and is placed in front of the leading edge to be coated to displace electrolyte and reduce the electrical field near the leading edge of the bucket. Some field lines are interrupted by the insulator thereby reducing the electrical field. The profile of the electrical field distributor is altered to achieve a uniform electrical field at the leading edge 42.

The profile and size of the electrical field distributor 64 or insulator can be altered to control the electrical field distribution for uniform coating at the leading edge which is a sharp tip. Other field distribution can also be obtained by different and special insulating blocks or electrical field distributors 64. Such a control of electrical field in space can effectively improve coating quality when sharp geometry is involved.

After the processing of contact plasma oxidation, the coated leading edge 42 surface is cleaned and dried to remove any residual electrolyte and loose material. If the top layer is loose, the use of abrasive lapping or polishing may be required to remove such material. Polishing is optional as the next sealing layer can solidify the loose material. The bottom layer on the base metal is denser and less porous than the top layer. Also, high power frequency can reduce the coating porosity.

On top of the titania coating, another layer of coating is applied to seal the porosity for better toughness and integrity. The top sealing layer material is selected from the group consisting of hard metals, such as chromium, cobalt, or nickel. In an alternate embodiment the sealing layer material is selected from the group consisting of polymers, such as polyimide, PTFE, or polyester.

Metallic coating methods include electroplating, electroless plating, or PVD/CVD. These processes take place at low temperature, e.g. less than the recrystallizing temperature of the titanium alloy. The processes apply either electrical energy or chemical energy rather than direct thermal energy to activate the coating particles. Polymer masking or partial sealing is necessary to shield the areas that are not coated in the contact plasma process.

Polymer coating methods include spraying, dipping, or powder coating followed by curing or settling if necessary. Electrostatic spraying or wet electrophoretic plating may be applied to improve the quality of the coating by better filling of the surface pores.

The sealing material fills the pores and other voids to increase the coating toughness in addition to the high hardness of titania. The composite coating is either hard metal in ceramic matrix or polymer in ceramic matrix.

Described herein is a method that allows coating on titanium without forming brittle intermetallics. The conversion coating described herein enables strong bonding without adhesion problems. The coating is thick and durable, and has a thickness up to about 200 microns. The thickness of the titania layer is between about 20 microns and about 150 microns. The thickness of the top sealing layer is between about 0.5 and about 50 microns, or in embodiments from about 1.0 microns to about 40 microns, or in embodiments from about 2.0 microns to about 35 microns.

Hardness of the coating increases from 360 HV of the base airfoil alloy to about 1200 HV of coated titania to increase erosion resistance significantly. The titanium oxide is chemically stable for better corrosion resistance in addition to erosion resistance. The top seal coating by hard metal or tough polymer further improves the toughness against fracture and layer integrity.

Provided herein is a viable hard coating to titanium buckets that have less tolerance to erosion loss and lower yield strength than some stainless buckets. Near zero erosion loss after coating is provided by the method described herein. The coating also prolongs the service life of expensive titanium last stage buckets. The present invention may provide for longer turbine buckets and fewer turbine stages for the same power and efficiency due to increased annulus area and efficiency without erosion loss from higher tip speed.

The terms "first," "second," and the like, herein do not denote any order, quantity, or importance, but rather are used to distinguish one element from another, and the terms "a" and "an" herein do not denote a limitation of quantity, but rather denote the presence of at least one of the referenced items. The modifier "about" used in connection with a quantity is inclusive of the stated value and has the meaning dictated by the context, (e.g., includes the degree of error associated with measurement of the particular quantity). The suffix "(s)" as used herein is intended to include both the singular and the plural of the term that it modifies, thereby including one or more of that term (e.g., the metal(s) includes one or more metals). Ranges disclosed herein are inclusive and independently combinable (e.g., ranges of "up to about 25 w/o, or, more specifically, about 5 w/o to about 20 w/o", are inclusive of the endpoints and all intermediate values of the ranges of "about 5 w/o to about 25 w/o," etc).

While various embodiments are described herein, it will be appreciated from the specification that various combinations of elements, variations or improvements therein may be made by those skilled in the art, and are within the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method of forming a bucket for use in the last stage of a steam turbine engine, said method comprising:

forming a bucket comprising a titanium-based alloy having between about 3% and 6.25% by weight aluminum, up to 3.5% vanadium, up to 2.25% tin, up to 2.25% zirconium, between about 1.75% and 5.0% molybdenum, up to 2.25% chromium, up to 0.7% silicon and up to 2.3% iron, with the balance being titanium;

applying a high voltage to a leading edge of said bucket to form a transition layer of titania having a plurality of pores and wherein the transition layer of titania has a thickness of from about 20 microns to about 150 microns, said titania directly adhered to the titanium-based alloy, wherein an electrical field at the leading edge is controlled by an insulator positioned in an electrolyte, and sealing the transition layer of titania by filling the plurality of pores with a material selected from the group consisting of chromium, cobalt, nickel, polyimide, polytetrafluoroethylene and polyester.

2. The method according to claim 1, wherein said sealing layer comprises a thickness of from about 0.5 microns to about 50 microns.

3. The method according to claim 1, wherein the bucket further comprises a trailing edge and wherein said trailing edge comprises a transition layer of titania having a plurality of pores, and a top sealing layer filling the plurality of pores said top sealing layer selected from the group consisting of chromium, cobalt nickel, polyimide, polytetrafluoroethylene and polyester.

4. A method for manufacturing a last stage turbine bucket for use in a steam turbine engine, comprising:

forming a steam turbine bucket comprising a titanium-based alloy having between about 3% and 6.25% by weight aluminum, up to 3.5% vanadium, up to 2.25% tin, up to 2.25% zirconium, between about 1.75% and 5.0% molybdenum, up to 2.25% chromium, up to 0.7% silicon and up to 2.3% iron, with the balance being titanium;

applying a high voltage to a leading edge of said steam turbine bucket in an electrolyte to form a porous titania transition layer, wherein an electrical field at the leading edge is controlled by an insulator positioned in the electrolyte, wherein the porous titania transition layer has a thickness of from about 20 microns to about 150 microns; and sealing the porous titania transition layer with a material selected from the group consisting of chromium, cobalt, nickel, polyimide, polytetrafluoroethylene and polyester.

5. The method of claim 4 further comprising:

polishing the leading edge after the applying of the high voltage.

6. The method of claim 5, wherein the polishing comprises an abrasive grinding process.

7. The method of claim 4, wherein the high voltage is from about 300 Volts to about 1200 Volts.

8. The method of claim 4, wherein the high voltage is provided by a power source comprising a frequency from about 20 Hz to about 12000 Hz.

9. The method of claim 8, wherein the power source provides an alternating current, a direct current, or a pulsed direct current.

10. The method of claim 4, wherein the insulator is shaped to provide a uniform electrical field at the leading edge.

11. The method of claim 4, wherein the electrolyte comprises a pH greater than about 9.

12. The method of claim 4, wherein the electrolyte comprises a conductivity of from about 0.3 millisiemens/cm to about 12 millisiemens/cm.

13. The method of claim 4, wherein the electrolyte comprises potassium hydroxide.

14. The method of claim 13, wherein the potassium hydroxide comprises a concentration of from about 0.02 rams/liter to about 0.2 grams/liter.

15. The method of claim 4, wherein the electrolyte comprises sodium silicate.

16. The method of claim 4, wherein the sealing comprises electroplating, plasma vapor deposition or chemical vapor deposition of a metal.

17. The method of claim 4, wherein the sealing comprises spray coating, dip coating or powder coating and curing of a polymer.

18. A method of forming an article, the method comprising:

forming a titanium-based alloy bucket, comprising a titanium-based alloy having between about 3% and 6.25% by weight aluminum, up to 3.5% vanadium, up to 2.25% tin, up to 2.25% zirconium, between about 1.75% and 5.0% molybdenum, up to 2.25% chromium, up to 0.7% silicon and up to 2.3% iron, with the balance being titanium, wherein said bucket includes a leading edge;

applying a high voltage to the leading edge of said titanium-based alloy bucket in an electrolyte, wherein an electrical field at the leading edge is controlled by an insulator positioned in the electrolyte, wherein the high voltage forms a porous titania transition layer having a thickness of from about 20 microns to about 150 microns, said titania directly adhered to the titanium-based alloy; and sealing the porous titania transition layer with a material selected from the group consisting of chromium, cobalt, nickel, polyimide, polytetrafluoroethylene and polyester to form the top sealing layer.

* * * * *